US006094813A

United States Patent [19]

Akeda et al.

[11] Patent Number: 6,094,813

[45] Date of Patent: Aug. 1, 2000

[54] CONNECTOR FOR AUTOMATIC TRANSMISSION AND METHOD OF ASSEMBLING THE SAME

[75] Inventors: Nobuyuki Akeda; Takahiro Sano, both of Shizuoka, Japan

[73] Assignee: Yazaki Corporation, Tokyo, Japan

[21] Appl. No.: 09/224,352

[22] Filed: Jan. 4, 1999

Related U.S. Application Data

[62] Division of application No. 08/917,143, Aug. 25, 1997, Pat. No. 5,885,114.

[30] Foreign Application Priority Data

Aug. 26, 1996 [JP] Japan ..... 8-223737

[51] Int. Cl.[7] ..... H01R 43/02

[52] U.S. Cl. ..... 29/877; 29/458; 29/530; 29/527.2; 29/885

[58] Field of Search ..... 29/530, 458, 460, 29/874, 883, 884, 877, 878, 885, 527.2; 439/752

[56] References Cited

U.S. PATENT DOCUMENTS 4,426,762 1/1984 Schnedecker ..... 29/530 X
5,286,944 2/1994 Li ..... 29/885
5,292,261 3/1994 Hirano et al. ..... 439/752
5,535,512 7/1996 Armogan ..... 29/877
5,569,055 10/1996 Yamanashi et al. ..... 439/752

FOREIGN PATENT DOCUMENTS 8-124623 5/1986 Japan .

*Primary Examiner*—David P. Bryant
*Assistant Examiner*—Marc W. Butler
*Attorney, Agent, or Firm*—Morgan, Lewis & Bockius LLP

[57] ABSTRACT

In an automatic transmission connector for interconnecting circuits provided inside and outside an automatic transmission, there are provided a plurality of terminals, a housing for receiving the terminals, and a rear holder engageable with the housing. The housing has a plurality of cavities for receiving the terminals, respectively, and the cavities are separated from one another in such a manner that the cavities communicate with one another through partially-notched wall portions. The housing has terminal passage holes into which the terminals are press-fitted, respectively. The rear holder has wall piece portions, and when the rear holder is engaged with the housing, the wall piece portions cooperate with notches, formed in the wall portions of the cavities, to separate the cavities from one another, and also retain the terminals within the respective cavities.

11 Claims, 8 Drawing Sheets

CONNECTOR FOR AUTOMATIC TRANSMISSION AND METHOD OF ASSEMBLING THE SAME

This application is a divisional application of U.S. patent application Ser. No. 08/917,143, filed on Aug. 25, 1997 now U.S. Pat. No. 5,885,114, This application claims priority to Japanese Patent Application No. Hei. 8-223737, filed on Aug. 26, 1996.

BACKGROUND OF THE INVENTION

This invention relates to an automatic transmission connector for interconnecting circuits provided inside and outside an automatic transmission, and a method of assembling this connector, and more particularly to a connector for an automatic transmission in which a sealing resin material can be certainly and easily filled in cavities so as to enhance a sealing effect, and a method of assembling this connector.

An electric circuit, such as a solenoid, is contained, together with transmission oil, in a transmission casing of an automatic transmission, and this circuit is connected to a control device such as a control unit, provided outside the transmission casing, through an automatic transmission connector mounted on a side wall of the transmission casing.

In such an automatic transmission connector, the interior of a connector housing is sealed by a sealing resin material so that the oil in the transmission casing will not leak to the exterior along circuit-connecting wires and that water will not intrude from the exterior into the transmission casing along the wires.

FIGS. 6(*a*) and 6(*b*) show a conventional connector for an automatic transmission. FIG. 6(*a*) is a side cross-sectional view, and FIG. 6(*b*) is a front view as seen in a direction of arrow R in FIG. 6(*a*).

In FIGS. 6(*a*) and 6(*b*), the conventional automatic transmission connector 100 comprises a plurality of terminals 101, a housing 110 receiving these terminals 101, a rubber plug 120 fitted in the housing 110, and an 0-ring 130 mounted on a body of the housing 110.

The housing 110 includes a plurality of cavities 111 separated from one another by wall portions 111*a*, terminal passage holes 112 which communicate respectively with the cavities 111 and through which the terminals 101 pass, lances 113 each retaining the associated terminal 101 in the cavity 111, an injection hole 114 for a sealing resin material 40, and a filling space 115 which is continuous with the injection hole 114 and is filled with the sealing resin material 40.

Next, a method of assembling the above conventional automatic transmission connector will be described with reference to FIGS. 7(*a*), 7(*b*), 8(*a*) and 8(*b*).

FIGS. 7(*a*), 7(*b*) and 8(*a*) are views respectively showing steps of the method of assembling the conventional automatic transmission connector, and FIG. 8(*b*) is a view showing the state of inflow of the sealing resin material.

First, the terminals 101 are inserted respectively into the cavities 111 as shown in FIG. 7(*a*). As a result, the lance 113 in each cavity 111 retains the inserted terminal 101, so that the terminal 101 is fixed within the cavity 111. Then, the rubber plug 120 is fitted into the housing 110, so that the filling space 115 for the sealing resin material 40 is formed.

Then, as shown in FIG. 7(*b*), the housing 110 is vertically placed with the terminals 101 disposed at the upper portion, and the sealing resin material 40 is filled into the filling space 115 through the injection hole 114 in the housing 110.

As a result, the sealing resin material 40 flows through the injection hole 114 into the filling space 115, and further reaches the cavities 111, as shown in FIG. 8(*b*).

Thereafter, the sealing resin material 40, filled in the housing 110, is cured by application of heat thereto, so that the resin-sealing within the housing 110 is completed (FIG. 8(*a*)). Thus, the assembling of the connector is completed.

In the above conventional automatic transmission connector, however, the cavities 111 are completely separated from one another by the wall portions 111*a*, and the lances 113 are provided respectively within the cavities 111, so that the construction is complicated. Therefore, the sealing resin material 40 of high viscosity can not easily flow into the cavities 111, and there has been encountered a problem that the positive resin-sealing between the terminals 101 has been difficult.

In the method of assembling the conventional automatic transmission connector, the sealing resin material 40 is caused to flow from the filling space 115 at the lower position into the cavities 111 at the upper position, that is, the sealing resin material 40 is caused to flow from the lower position to the upper position against the gravity, and therefore there has been encountered a problem that the sealing resin material can not be easily filled in the cavities 111, so that the sealing between the terminals 101 can not be ensured.

SUMMARY OF THE INVENTION

The present invention has been made in view of the above problems, and an object of the invention is to provide a connector for an automatic transmission in which a sealing resin material can be certainly and easily filled into cavities, thereby enhancing a sealing performance, and also to provide a method of assembling such a connector.

In order to achieve the above object, according to the present invention, an automatic transmission connector for interconnecting circuits provided inside and outside an automatic transmission, comprises a plurality of terminals, a housing for receiving the terminals, and a rear holder engageable with the housing; wherein the housing has a plurality of cavities for receiving the terminals, respectively, and the cavities are separated from one another in such a manner that the cavities communicate with one another through partially-notched wall portions, and the housing has terminal passage holes into which the terminals are press-fitted, respectively; and wherein the rear holder has a wall piece portion, and when the rear holder is engaged with the housing, the wall piece portion cooperates with notches, formed in the wall portions of the cavities, to separate the cavities from one another, and also retains the terminals within the respective cavities.

In this construction, the wall portions, separating the cavities from one another, are notched, so that the cavities communicate with each other, and therefore the sealing resin material can easily flow into the cavities.

The notches wall portions are closed by the wall piece portion formed on the rear holder, and therefore when the housing and the rear holder are engaged with each other, the cavities are completely separated from one another.

The terminals are retained respectively in the cavities by the terminal passage holes (in which the terminals are press-fitted, respectively) and the wall piece portion of the rear holder, and therefore there is no need to provide a lance within each cavity as in the conventional construction.

Therefore, the internal structure of each cavity is quite simple, and the sealing resin material can easily flow into the cavities.

Preferably, a guide groove is formed in one of an inner surface of a side wall of the housing and an outer surface of a side wall of the rear holder while a guide rail for being guided by the guide groove is formed on the other. Further, an engagement hole may be formed in the guide groove, and an engagement pawl for engagement with the engagement hole is formed on the guide rail.

With this construction, after the sealing resin material (which usually has a black color) is filled in the housing, the housing and the rear holder are positioned to each other by the guide groove and the guide rail even if the interior of the housing can not be viewed, and therefore the housing and the rear holder can be easily engaged with each other.

In a method for assembling the automatic transmission connector according to the present invention, the terminals are press-fitted respectively into the terminal passage holes in the housing and are received respectively in the cavities; subsequently the housing is vertically placed with the terminals disposed at a lower portion, and then a sealing resin material is filled in the cavities; and subsequently before the sealing resin material is cured, the rear holder is engaged with the housing.

In this assembling method, the sealing resin material can be poured directly into the cavities, and the sealing resin material can be caused to flow smoothly into the cavities by gravity. The rear holder is inserted into the housing after the sealing resin material is poured, and therefore the rear holder will not adversely affect the pouring of the sealing resin material and the flow of the poured sealing resin material.

BRIEF DESCRIPTION OF THE DRAWINGS

FIG. 2(*b*) is a plan view as seen in a direction Q of FIG. 1;

FIG. 4(*b*) is an explanatory view showing a rear holder-attaching step in the above method;

FIG. 5(*b*) is a conceptual view showing the state of inflow of the resin sealing material in the above assembling method;

FIG. 8(*b*) is a conceptual view showing the state of inflow of a sealing resin material in the above conventional assembling method.

DETAILED DESCRIPTION OF THE INVENTION

A preferred embodiment of an automatic transmission connector of the invention, as well as a method of assembling the connector, will now be described with reference to the drawings.

First, the preferred embodiment of the automatic transmission connector of the invention will be described with reference to FIGS. 1, 2(*a*) and 2(*b*).

Figure 1:
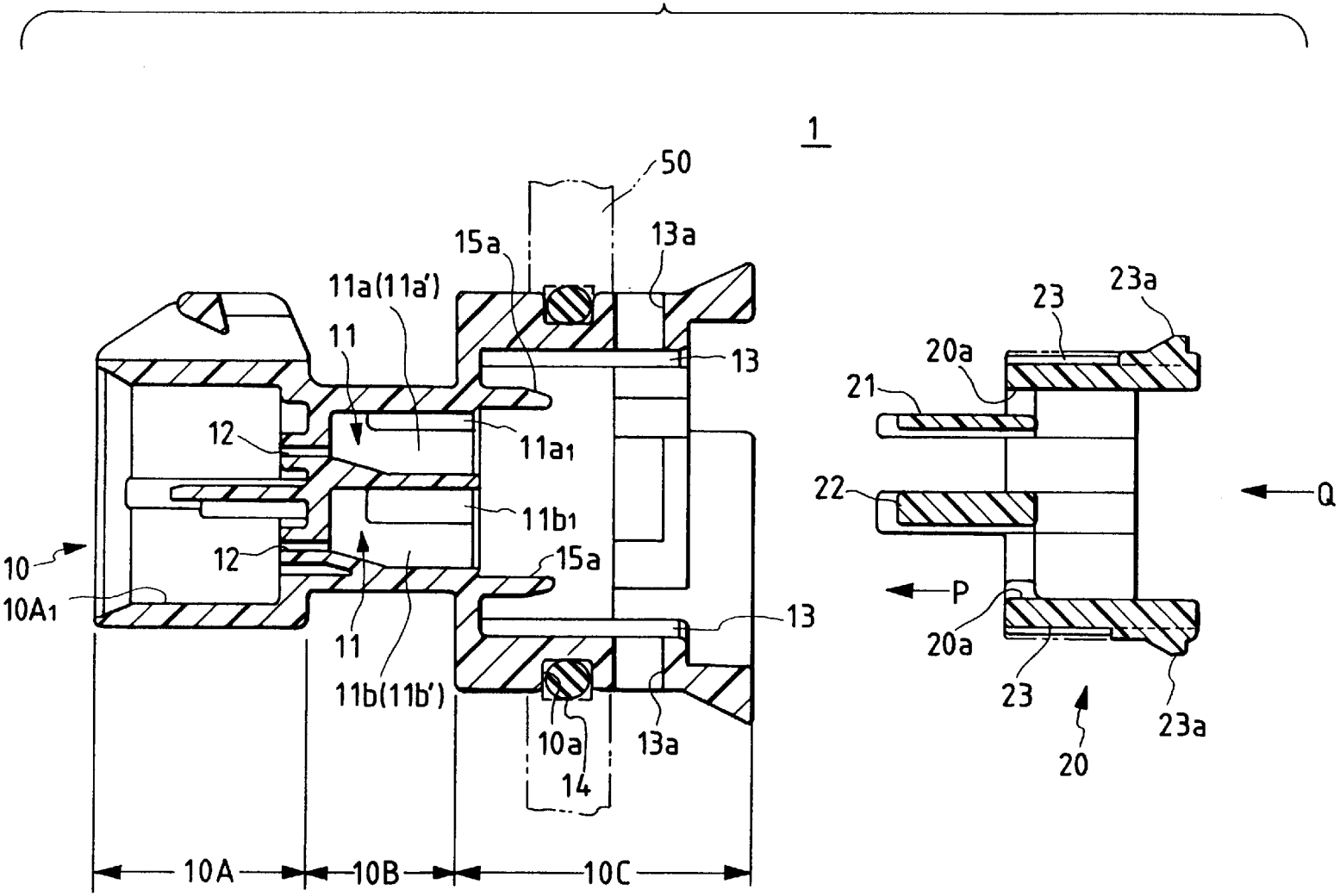
FIG. 1 is a side cross-sectional view showing a housing and a rear holder in a preferred embodiment of an automatic transmission connector of the invention.
Figure 2A:
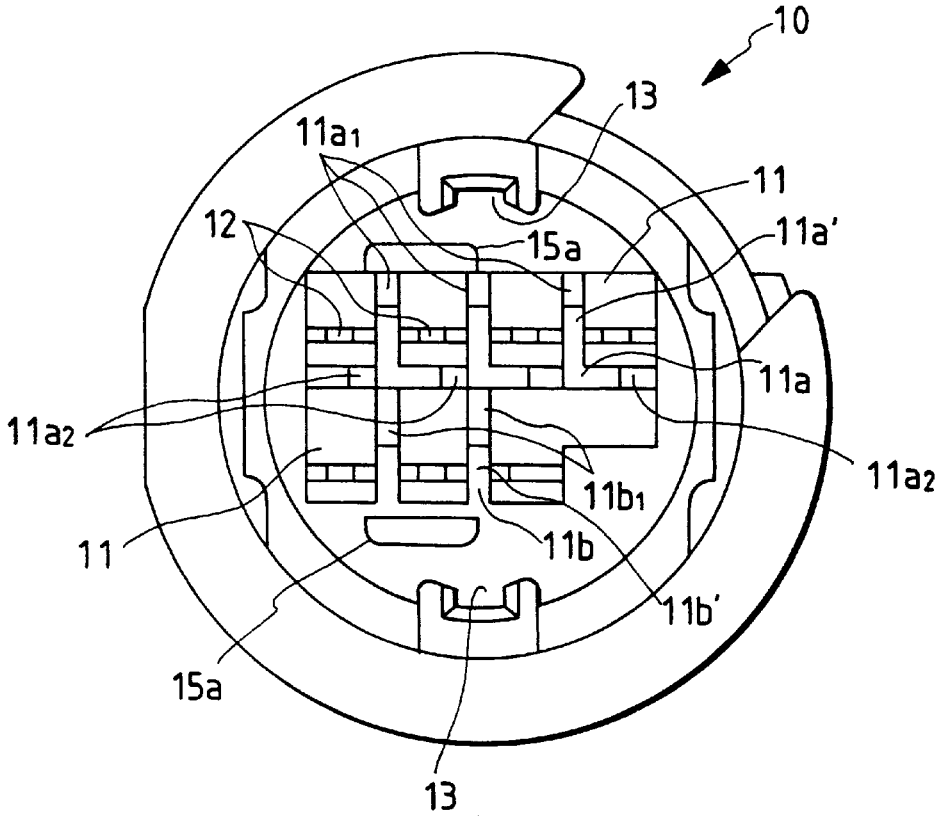
FIG. 2(*a*) is a plan view as seen in a direction P of FIG. 1.
Figure 2B:
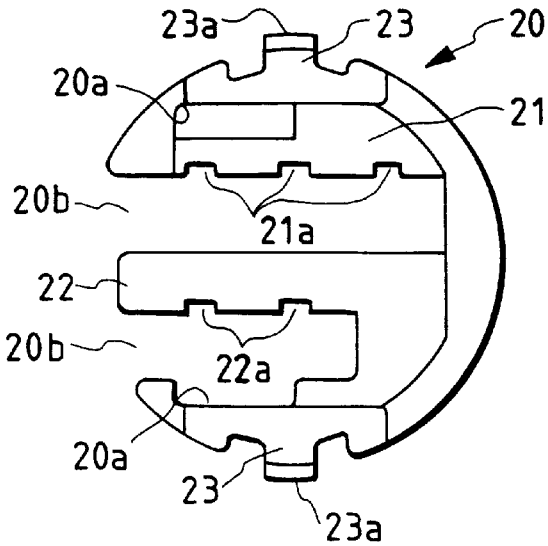

FIG. 1 is a side cross-sectional view showing a housing and a rear holder in the automatic transmission connector, FIG. 2(*a*) is a plan view as seen in a direction P of FIG. 1, and FIG. 2(*b*) is a plan view as seen in a direction Q of FIG. 1.

In FIG. 1, a housing 10 of an automatic transmission connector 1 includes a receiving portion 10A for receiving a mating connector (not shown), a terminal receiving portion 10B, and a rear holder receiving portion 10C.

In FIG. 2(*a*), a plurality of cavities 11 are provided within the terminal receiving portion 10B, and the cavities 11 are separated from one another by first wall portions 11*a* of a generally L-shape and second wall portions 11*b*, which are partially notched, in such a manner that the cavities communicate with one another. More specifically, the first wall portions 11*a* has notches $\mathbf{11}a_1$ and $\mathbf{11}a_2$, and the second wall portion 11*b* has a notch $\mathbf{11}b_1$.

Figure 3:
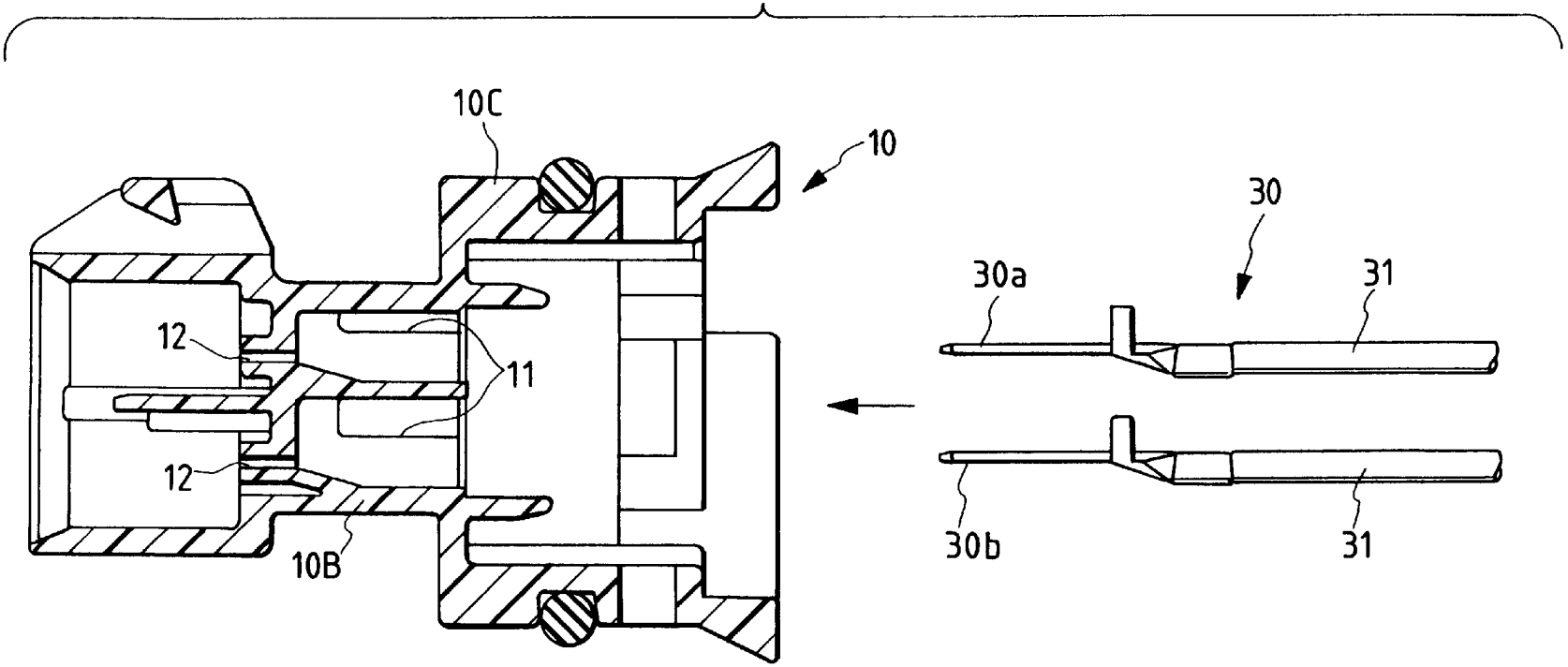
FIG. 3 is an explanatory view showing a terminal-inserting step in a method of assembling the automatic transmission connector of the above embodiment.

As shown in FIGS. 1 and 2(*a*), each cavity 11 has a terminal passage hole 12 communicating the cavity 11 with the receiving portion 10A, and an electrical contact portion 30*a* of a terminal 30 shown in FIG. 3 is press-fitted into the terminal passage hole 12. Therefore, the plurality of terminals 30 are received in the cavities 11, respectively. The electrical contact portion 30*a* of the terminal 30, press-fitted in the terminal passage hole 12, projects into a hood $\mathbf{10}A_1$ of the receiving portion 10A.

Two guide grooves 13 and 13 are formed in an inner surface of a side wall of the rear holder receiving portion 10C, and extend toward the cavities 11. Two engagement holes 13*a* and 13*a* are formed through the side wall of the rear holder receiving portion 10C, and communicate with the guide grooves 13 and 13, respectively.

A groove 10*a* is formed in an outer surface of the side wall of the rear holder receiving portion 10C, and an O-ring 14 for sealing engagement with a side wall 50 of a transmission casing is received in this groove 10*a*.

Two projected piece portions 15*a* and 15*a* are formed generally perpendicularly on a wall portion provided at the boundary between the rear holder receiving portion 10C and the terminal receiving portion 10B. The projected piece portions 15*a* and 15*a* contact inner surfaces 20*a* and 20*a* of the rear holder 20, respectively, to correct deformation of the rear holder 20.

Figure 4B:
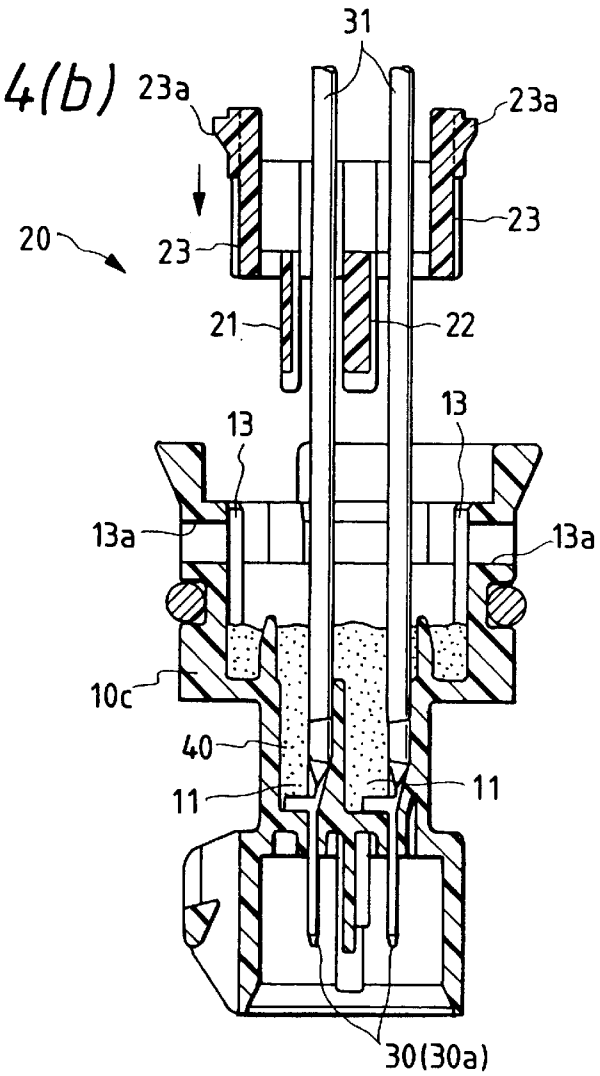
FIG. 4(*a*) is an explanatory view showing a sealing resin material-pouring step in the method of assembling the automatic transmission connector of the above embodiment.
Figure 4A:
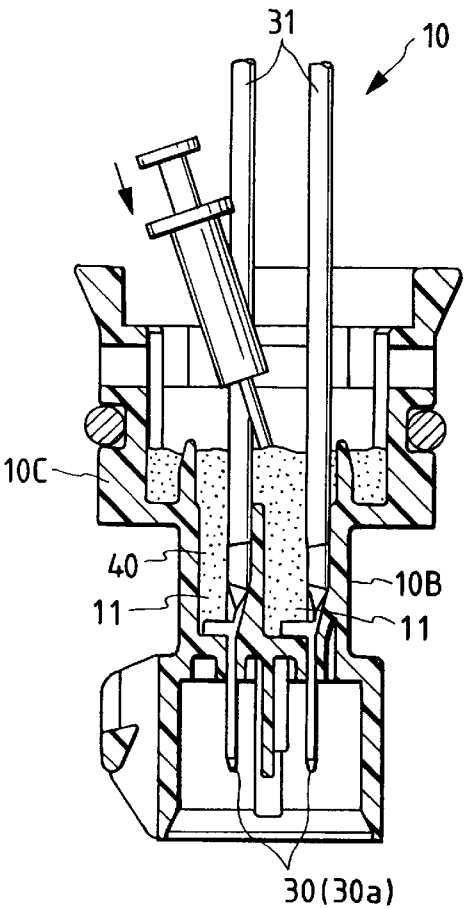

As shown in FIG. 2(*b*), the rear holder 20 has notches 20*b* for passing wires 31, extending outwardly respectively from the cavities 11, through the rear holder 20 as shown in FIG. 4(*b*). Therefore, the rear holder 20 is liable to be deformed inwardly upon application of heat and so on. In order to correct the deformation of the rear holder 20, the projected piece portions 15*a* and 15*a* urge the inner surfaces 20*a* and 20*a* of the deformed rear holder 20 outwardly when the rear holder 20 is inserted into the rear holder receiving portion 10C, thereby correcting the deformation.

In FIGS. 1 and 2(*b*), the rear holder 20 of the automatic transmission connector 1 has first and second projecting wall piece portions 21 and 22 which cooperate with the notches $11a_1$, $11a_2$ and $11b_1$, formed in the first and second wall portions 11*a* and 11*b* of the cavities 11, to separate the cavities 11 from one another when the rear holder 20 is engaged in the housing 10.

When the rear holder 20 is engaged in the housing 10, the first wall piece portion 21 is inserted into the notches $11a_1$ in the first wall portions 11*a* to close these notches $11a_1$, and also locks the terminals 30, received respectively in the cavities 11 formed respectively by the first wall portions 11*a*, at its distal end.

In order to achieve the intimate contact of the first wall piece portion 21 with the first wall portions 11*a*, three grooves 21*a* for respectively fitting on upper ends of vertical walls 11*a*' of the first wall portions 11*a* are formed in the first wall piece portion 21.

When the rear holder 20 is engaged in the housing 10, the second wall piece portion 22 is inserted into the notches $11b_1$, formed respectively in the second wall portions 11*b*, to close these notches $11b_1$ and the notches $11a_2$ formed respectively in the first wall portions 11*a*. At the same time, the second wall piece portion 22 locks the terminals 30, received respectively in the cavities 11 formed respectively by the second wall portions 11*b*, at its distal end.

In order to achieve the intimate contact of the second wall piece portion 22 with the second wall portions 11*b*, two grooves 22*a* for respectively fitting on upper ends of vertical walls 11*b*' of the second wall portions 11*b* are formed in the second wall piece portion 22.

Two guide rails 23 and 23, corresponding respectively to the guide grooves 13 and 13 formed in the housing 10, are formed on the outer surface of the rear holder 20, and engagement pawls 23*a* and 23*a* for engagement in the respective engagement holes 13*a* and 13*a* are formed respectively on the guide rails 23 and 23 in generally continuous relation thereto.

In this embodiment, the guide grooves 13 and 13 are provided in the housing 10 while the guide rails 23 and 23 are provided on the rear holder 20; however, in contrast with this, the guide rails 23 and 23 may be provided on the housing 10, and guide grooves may be provided in the rear holder 20.

A method of assembling the automatic transmission connector of the invention will now be described with reference to FIGS. 3, 4(*a*), 4(*b*), 5(*a*) and 5(*b*).

Figure 5A:
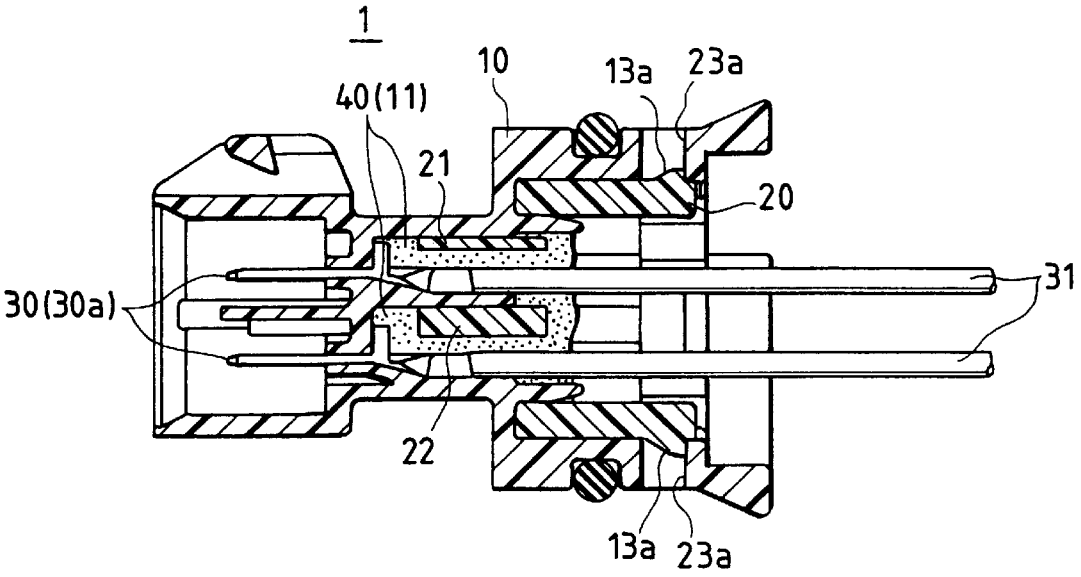
FIG. 5(*a*) is an explanatory view showing a final step in the method of assembling the automatic transmission connector of the above embodiment.
Figure 5B:
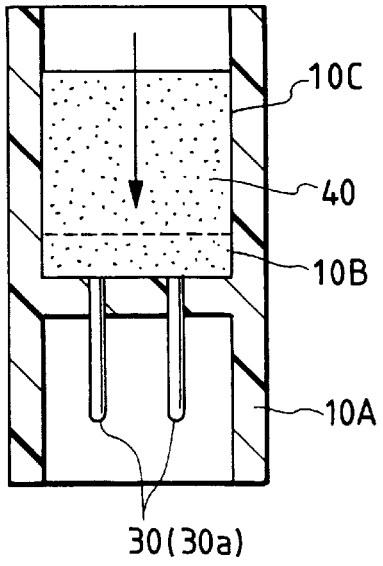

FIGS. 3, 4(*a*), 4(*b*) and 5(*a*) show steps of the method of assembling the automatic transmission connector of this embodiment, and FIG. 5(*b*) is a conceptual view showing the state of inflow of a sealing resin material in this assembling method First, the terminals 30 are inserted respectively into the cavities 11 in the housing 10, and the tip end of the terminals 30 are press-fitted respectively into the terminal passage holes 12, so that the terminals 30 are received respectively in the cavities 11, as shown in FIG. 3. The terminal passage holes 12 are closed respectively by the terminals 30 press-fitted thereinto.

Then, as shown in FIG. 4(*a*), the housing 10 is vertically placed with the terminals 30 disposed at the lower portion, and the sealing resin material 40 of an amount enough to fill the cavities 11 is filled into the housing from the rear holder receiving portion 10C. As a result, the sealing resin material 40 flows downward from the upper portion to the lower portion (that is, from the rear holder receiving portion 10C to the terminal receiving portion 10B) under the influence of gravity, so that the sealing resin material 40 smoothly flows into the cavities 11 through the notches $11a_1$, $11a_2$ and $11b_1$ (see FIG. 2(*a*)).

Then, as shown in FIG. 4(*b*), before the sealing resin material 40 is cured, the rear holder 20 is inserted into the rear holder receiving portion 10C of the housing 10 in such a manner that the guide rails 23 and 23 move along the guide grooves 13 and 13, respectively. As a result, the first and second wall piece portions 21 and 22 of the rear holder 20 are inserted respectively into the notches $11a_1$ in the first wall portions 11*a* and the notches $11b_1$ in the second wall portions 11*b* to close the notches $11a_1$, $11a_2$ and $11b_1$ (see FIG. 2(*a*)).

Thus, the first and second wall piece portions 21 and 22 are inserted respectively into the notches $11a_1$ in the first wall portions 11*a* and the notches $11b_1$, in the second wall portions 11*b*, so that the sealing resin material 40 is certainly forced into the cavities 11.

When the rear holder 20 is completely inserted into the rear holder receiving portion 10C of the housing 10, the engagement pawls 23*a* and 23*a* of the rear holder 20 are engaged respectively in the engagement holes 13*a* and 13*a* in the housing 10. At this time, the distal ends of the first and second wall piece portions 21 and 22 engage the terminals 30 in the respective cavities 11 to retain the terminals 30 in the cavities 11.

Thereafter, heat is applied to cure the sealing resin material 40 poured into the housing 10, and the resin sealing of the interior of the housing 10 is completed (FIG. 5(*a*)). Thus, the assembling of the connector is completed.

In the automatic transmission connector 1 of this embodiment, the first and second wall portions 11*a* and 11*b*, separating the cavities 11 from one another, are notched, so that the cavities 11 communicate with one another, and with this construction the sealing resin material 40 can easily flow into the cavities 11.

The notched first and second wall portions 11*a* and 11*b* are compensated by the first and second wall piece portions 21 and 22 provided in the rear holder 20, and therefore when the rear holder 20 is engaged in the housing 10, the cavities 11 are completely separated from one another.

Figure 6A:
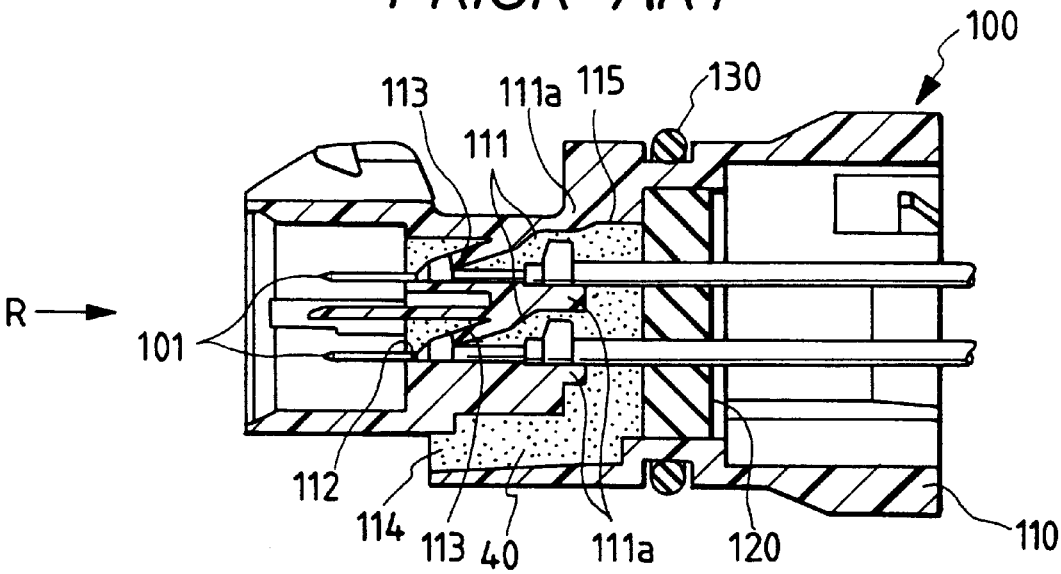
FIG. 6(a) PRIOR ART
FIGS. 6(*a*) and 6(*b*) show a conventional automatic transmission connector, FIG. 6(*a*) being a side cross-sectional view thereof, and FIG. 6(*b*) being a front view as seen in a direction R of FIG. 6(*a*)
Figure 6B:
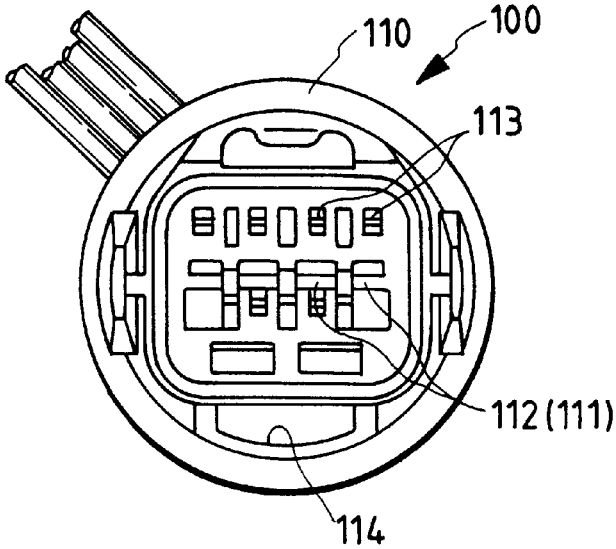
FIG. 6(b) PRIOR ART
Figure 7A:
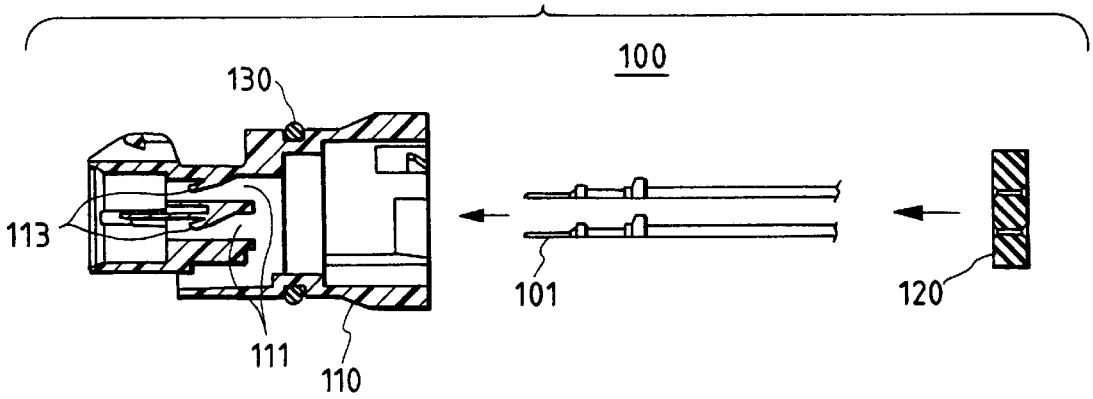
FIG. 7(a) PRIOR ART
FIGS. 7(*a*) and 7(*b*) are explanatory views showing steps of a method of assembling the conventional automatic transmission connector.
Figure 7B:
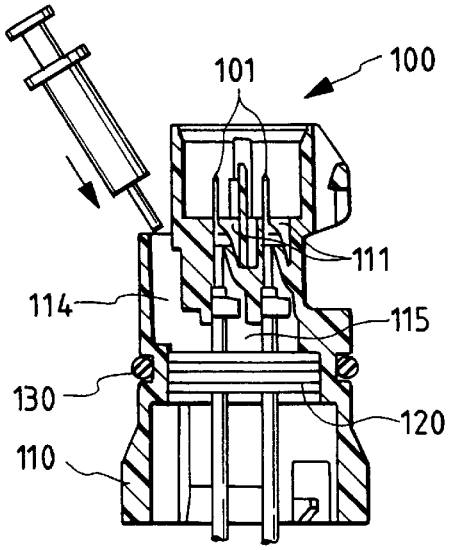
FIG. 7(b) PRIOR ART
Figure 8A:
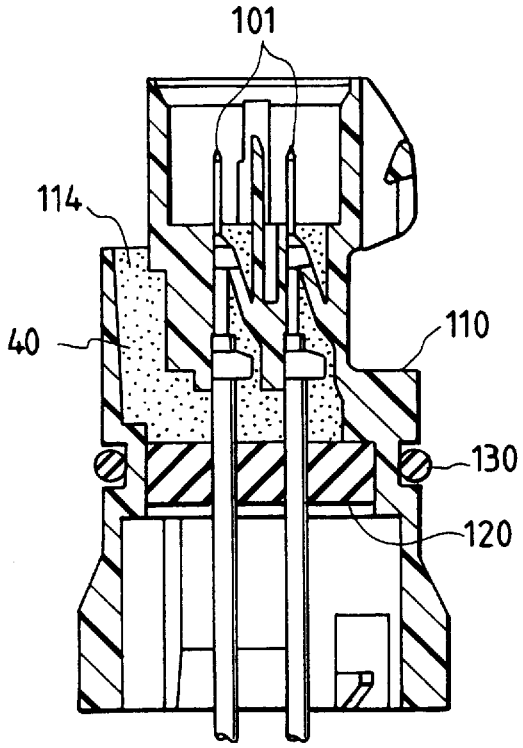
FIG. 8(a) PRIOR ART
FIG. 8(*a*) is an explanatory view showing a final step of the method of assembling the conventional automatic transmission connector subsequent to the step of FIG. 7(*b*)
Figure 8B:
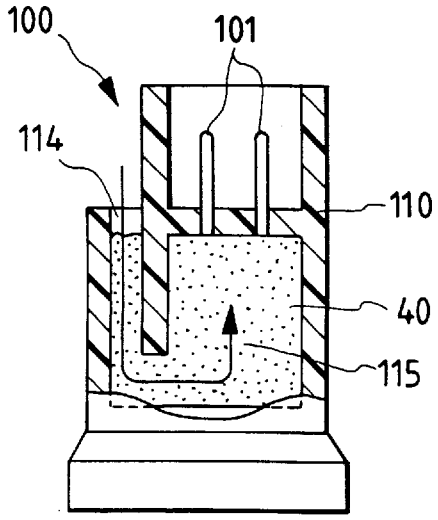
FIG. 8(b) PRIOR ART

The terminals 30 are retained in the respective cavities 11 by the terminal passage holes 12 (in which the terminals 30 are press-fitted, respectively) and the first and second wall piece portions 21 and 22 of the rear holder 20, and therefore there is no need to provide the lance 113 (see FIG. 6(*a*) within each cavity 11 as in the conventional construction.

Therefore, the internal structure of the cavity 11 is quite simple, and the sealing resin material 40 can easily flow into the cavities 11.

In addition, after the sealing resin material 40 (which usually has a black color) is filled in the housing 10, the housing 10 and the rear holder 20 can be accurately positioned to each other because of the provision of the guide grooves 13 and the guide rails 23 even if the interior of the housing can not be viewed.

In the method of assembling the automatic transmission connector of this embodiment, the sealing resin material 40 can be poured directly into the cavities 11, and the sealing resin material 40 can be caused to flow smoothly into the cavities 11 by gravity. The rear holder 20 is inserted into the housing 10 after the sealing resin material 40 is poured, and therefore the rear holder 20 will not adversely affect the pouring of the sealing resin material 40 and the flow of the poured sealing resin material 40.

As described above, in the automatic transmission connector of the invention and the method of the invention for assembling the same, the sealing resin material can be certainly and easily filled in the cavities, thereby enhancing the sealing effect.

What is claimed is:

1. A method of assembling an automatic transmission connector comprising a plurality of terminals, a housing for receiving the plurality of terminals, the housing including terminal passage holes, the housing including a plurality of cavities for receiving the plurality of terminals, the plurality of cavities being separated from one another in such a manner that the plurality of cavities communicate with one another through partially-notched wall portions, and a rear holder engageable with the housing, the rear holder including a wall piece portion such that when the rear holder is engaged with the housing, the wall piece portion cooperates with notches, formed in the wall portions of the plurality of cavities, to separate the cavities from one another, and the rear holder also retains the terminals within the plurality of cavities, the method comprising the steps of:

press-fitting the plurality of terminals into the terminal passage holes in the housing to receive the plurality of terminals in the plurality of cavities;

vertically placing the housing with the plurality of terminals disposed at a lower portion;

filling a sealing resin material into the plurality of cavities, wherein the sealing resin material flows between cavities through the notches; and engaging the rear holder with the housing before the sealing resin material is cured.

2. The method according to claim 1, wherein, during the press-fitting step, the rear holder is inserted into the housing such that a guide rail formed on one of an inner surface of a side wall of the housing and an outer surface of a side wall of the rear holder moves along a guide groove formed in the other surface.

3. The method according to claim 2, wherein, during the press-fitting step, an engagement hole formed in the guide groove engages an engagement pawl formed in the rear holder when the rear holder is inserted into the housing.

4. The method according to claim 1, wherein, during the press-fitting step, the plurality of cavities are separated from one another by L-shaped wall portions.

5. The method according to claim 1, wherein the rear holder that is substantially circular.

6. The method according to claim 1, wherein the sealing resin material flows from the rear holder to the plurality of cavities under an influence of gravity.

7. A method of assembling an automatic transmission connector for interconnecting circuits inside and outside an automatic transmission, the connector comprising a plurality of terminals, a housing for receiving the plurality of terminals and including terminal passage holes, the housing including a plurality of cavities for receiving the plurality of terminals, the plurality of cavities being separated from one another such that the plurality of cavities communicate with one another through partially-notched wall portions, and a substantially circular rear holder engageable with the housing, the rear holder including a wall piece portion such that when the rear holder is engaged with the housing, the wall piece portion cooperates with notches, formed in the wall portions of the cavities, to separate the cavities from one another, the rear holder retaining the plurality of terminals within the plurality of cavities, the method comprising the steps of:

press-fitting the plurality of terminals into the terminal passage holes in the housing to receive the plurality of terminals in the plurality of cavities;

vertically placing the housing with the plurality of terminals disposed at a lower portion;

filling a sealing resin material into the plurality of cavities, wherein the sealing resin material flows from the rear holder to the plurality of cavities under an influence of gravity; and engaging the rear holder with the housing before the sealing resin material is cured.

8. The method according to claim 7, wherein, during the press-fitting step, the rear holder is inserted into the housing such that a guide rail formed on one of an inner surface of a side wall of the housing and an outer surface of a side wall of the rear holder moves along a guide groove formed in the other surface.

9. The method according to claim 7, wherein, during the press-fitting step, an engagement hole formed in the guide groove engages an engagement pawl formed in the rear holder when the rear holder is inserted into the housing.

10. The method according to claim 7, wherein, during the press-fitting step, the plurality of cavities are separated from one another by L-shaped wall portions.

11. The method according to claim 7, wherein the sealing resin material flows between cavities through the notches.

* * * * *